US011852106B2

(12) United States Patent
Buehner et al.

(10) Patent No.: US 11,852,106 B2
(45) Date of Patent: Dec. 26, 2023

(54) VALVE FOR METERING A FLUID

(71) Applicant: Robert Bosch GmbH, Stuttgart (DE)

(72) Inventors: Martin Buehner, Backnang (DE); Matthias Boee, Ludwigsburg (DE); Nico Herrmann, Rastatt (DE); Stefan Cerny, Bietigheim-Bissingen (DE); Andreas Glaser, Stuttgart (DE); Axel Heinstein, Wimsheim (DE); Jochen Rose, Schwieberdingen (DE); Murat Ucal, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 333 days.

(21) Appl. No.: 16/607,140

(22) PCT Filed: May 3, 2018

(86) PCT No.: PCT/EP2018/061296
§ 371 (c)(1),
(2) Date: Oct. 22, 2019

(87) PCT Pub. No.: WO2018/206382
PCT Pub. Date: Nov. 15, 2018

(65) Prior Publication Data

US 2020/0386199 A1 Dec. 10, 2020

(30) Foreign Application Priority Data

May 10, 2017 (DE) ..... 102017207845.6

(51) Int. Cl.
*F02M 51/06* (2006.01)
*F02M 61/10* (2006.01)
*B05B 1/30* (2006.01)

(52) U.S. Cl.
CPC ..... *F02M 51/0685* (2013.01); *B05B 1/3053* (2013.01); *F02M 61/10* (2013.01)

(58) Field of Classification Search
CPC ..... F02M 51/0685; F02M 51/061; F02M 51/0664; F02M 61/10; F02M 61/20; F02M 63/0075; F02M 63/0077; B05B 1/3053
See application file for complete search history.

(56) References Cited

U.S. PATENT DOCUMENTS 6,510,841 B1 * 1/2003 Stier ..... F02M 51/0685 123/472
7,252,245 B2 * 8/2007 Nishiwaki ..... F02M 51/0685 239/585.4

(Continued)

FOREIGN PATENT DOCUMENTS

CN 102094736 A 6/2011
CN 104136761 A 11/2014

(Continued)

OTHER PUBLICATIONS

International Search Report for PCT/EP2018/061296, dated Jul. 12, 2018.

*Primary Examiner* — Christopher R Dandridge
(74) *Attorney, Agent, or Firm* — NORTON ROSE FULBRIGHT US LLP; Gerard Messina

(57) ABSTRACT

A valve includes an electromagnetic actuator, which has an armature in an armature space and guided on a valve needle operable by the actuator using the armature. A first and a second stop element that interact with a first and second end face, respectively, of the armature are situated on the valve needle. The armature has a spring receptacle, which is open towards the first end face of the armature, and into which a spring is inserted. The armature has at least one fluid channel, which, during operation, allows fluid to pass (Continued)

through between first and second regions of the armature space at the first and second end faces, respectively, of the armature. The fluid channel incorporates at least part of the spring receptacle. Sections of the fluid channel run radially outwards along a direction oriented from the first to the second end face and coaxial to a longitudinal axis.

22 Claims, 4 Drawing Sheets

(56) References Cited

U.S. PATENT DOCUMENTS

| | | | | |
|---|---|---|---|---|
| 2003/0075621 | A1* | 4/2003 | Morton | F02M 61/188 239/585.1 |
| 2003/0151014 | A1* | 8/2003 | Ogura | F02M 61/12 251/129.15 |
| 2003/0178509 | A1* | 9/2003 | Porter | F02M 51/0653 239/585.1 |
| 2005/0269432 | A1 | 12/2005 | Nishiwaki | |
| 2010/0263631 | A1* | 10/2010 | Reiter | F02M 51/0614 123/472 |
| 2015/0260135 | A1 | 9/2015 | Izzo et al. | |

FOREIGN PATENT DOCUMENTS

| | | | | | |
|---|---|---|---|---|---|
| CN | 106401823 | A | | 2/2017 | |
| CN | 106460750 | A | | 2/2017 | |
| CN | 110030131 | A | | 7/2019 | |
| DE | 102013222613 | A1 | | 5/2015 | |
| EP | 2918816 | A1 | | 9/2015 | |
| EP | 3009663 | A1 | | 4/2016 | |
| EP | 3156638 | A1 | * | 4/2017 | F02M 51/066 |
| EP | 3156638 | A1 | | 4/2017 | |
| IT | 3156638 | | * | 4/2017 | F02M 51/06 |
| JP | 2014134207 | A | | 7/2014 | |
| JP | 2015218664 | A | | 12/2015 | |
| WO | 0125614 | A1 | | 4/2001 | |
| WO | 0129402 | A1 | | 4/2001 | |
| WO | 0218776 | A1 | | 3/2002 | |

* cited by examiner

VALVE FOR METERING A FLUID

FIELD

The present invention relates to a valve for metering a fluid, in particular, a fuel injector for internal combustion engines. In particular, the present invention relates to the area of injectors for fuel-injection systems of motor vehicles, where direct injection of fuel into combustion chambers of an internal combustion engine preferably takes place.

BACKGROUND INFORMATION

A valve for metering fluid is described in German Patent No. DE 10 2013 222 613 A1. The conventional valve includes an electromagnet for actuating a valve needle that controls a metering orifice. The electromagnet is used for actuating an armature displaceable on a valve needle. In this connection, the armature includes a bore hole, which borders on the valve needle and forms a spring receptacle for a pre-stroke spring.

SUMMARY

An example valve of the present invention may have the advantage that an improved embodiment and method of functioning are rendered possible. In this connection, in particular, improved guidance between the armature and the valve needle, in particular, damping and quieting of the armature, and, simultaneously, advantageous passage of the fluid through an armature space, may take place.

Advantageous further refinements of the valve may rendered possible by the measures described herein.

In the case of the valve for metering the fluid, the armature used as a magnet armature is not rigidly connected to the valve needle, but slides between limit stops. Such a limit stop may be formed on a stop element, which may be implemented as a stop sleeve and/or stop ring. However, the stop element may also be formed in one piece with the valve needle. In the rest state, the armature is moved by a spring to a limit stop stationary with respect to the valve needle, so that the armature rests there. Then, upon activation of the valve, the entire free travel of the armature is available as an acceleration path; the spring being shortened during the acceleration. The free travel of the armature may be predetermined by the axial play between the armature and the two limit stops.

A guide length between the armature and the valve needle may be increased by forming the spring receptacle, using an annular groove not bordering on the valve needle. Nevertheless, in this connection, the spring receptacle may be formed advantageously close to the longitudinal axis, that is, at a short radial distance from the longitudinal axis, in order that, in the case of a corresponding embodiment of the valve, advantageous introduction of the fluid from the first region of the armature space into the spring receptacle is rendered possible.

In the case of a combination of an armature having straight flow-through bores and a limit stop, which is positioned on the valve needle and has a large outside diameter, it is possible for there to be overlapping between the flow-through bore and a stop face (limit stop) formed on a corresponding stop element. This eliminates a portion of the damping surface between the armature and the related stop element. In addition, a free flow cross section also decreases in the region of the end positions of the armature, at the stop elements.

The resulting situation has the advantage of a low adhesion effect upon release of the armature from the respective stop element during an actuating event, and also causes damping desired for damping an impact and/or for quieting the armature to be reduced. In particular, in the case of closing the valve, with regard to the desired activation times, this may cause an overly long time to be necessary for adequately quieting the armature. Thus, in view of time delays that are possibly very short, for example, less than 1.2 ms, as may be desired in the case of multiple injections, there are considerable disadvantages of a straight flow-through bore through the armature, formed close to the valve needle.

Advantageous passage of fluid through the armature may advantageously take place, using a proposed fluid channel, and at the same time, impairment of a damping action may be reduced, which is advantageous, in particular, for quieting the armature during the closing of the valve. In this manner, a selection or setting of the desired damping may also be made at least substantially uninfluenced by the passage of the fluid through the armature, using the structural refinement of the stop face on the stop element.

A further refinement of the present invention, in which a point of a first opening of the fluid channel, lying radially far outwards from the longitudinal axis to a maximum extent, is situated closer to the longitudinal axis than a point of a second opening of the fluid channel, lying radially far outwards from the longitudinal axis to a maximum extent, may have the advantage that introduction of the fluid into the fluid channel, close to the longitudinal axis, may advantageously take place at the first end face of the armature, while on the second end face of the armature, it is possible to shift the opening of the fluid channel into a region further removed from the valve needle. In a further refinement of the present invention, there may be, in particular, an advantage that overlapping of the opening of the fluid channel at the second end face of the armature by a stop face at the second stop element may be reduced or completely prevented. In particular, the point of the second opening of the fluid channel lying maximally far inwards may be situated radially outside of a stop face of the second stop element. Corresponding advantages may be achieved in the further refinement, in which a centroid of a first opening of the fluid channel is situated closer to the longitudinal axis than a centroid of a second opening of the fluid channel.

The further refinement according to FIG. 3 has, inter alia, the advantage that an ability to produce the fluid channel with the aid of a bore hole is rendered possible and/or improved. An advantageous measure for this is described herein.

A further refinement described herein may have an advantage that, first of all, a fluidically favorable embodiment of the fluid channel may be produced. Secondly, from a standpoint of production engineering, it is possible for a favorable form of the fluid channel to be implemented, as is possible, in particular, according to the further refinement according to claim 6. In this connection, according to the further refinement of claim 7, an optimization with regard to an angle of inclination, at which an axis of the oblique bore hole is tilted with respect to the longitudinal axis, may be advantageously implemented; for example, in the case of given requirements for the opening at the second end face of the armature, the angle of inclination being able to be kept optimally small. In addition, through this, the cross section available for the passage of the fluid, along the coaxial direction, over the entire path through the armature, may be increased as a result of the embodiment of the oblique bore hole, if this is practical in the specific application case.

In the further refinement of the present invention, a volume possibly remaining in the case of a deployed spring (spring for the free travel of the armature) may be also be used in an advantageous manner for the passage of the fluid. In this connection, the further refinement described herein may allow, in particular, the spring receptacle to be used along its entire extension along the longitudinal axis.

In the further refinement according to the present invention, the fluid channel may be formed in an advantageous manner, using coaxial blind-end bores simple to implement from the standpoint of production engineering.

Thus, a combination of a free-travel armature spring situated in the armature, with an armature, may be implemented; the armature having a fluid channel, in particular, an oblique bore hole, running radially outwards. This combination allows a damping surface having a maximum size to be produced between a stop element and the armature. In this case, in particular, a reduction in the damping surface due to an overlap with the corresponding opening may be prevented. Since a plurality of fluid channels, which are preferably produced in place of conventional flow-through bores, are provided in the embodiment of a valve, a considerable influence on the method of functioning of the valve, in particular, markedly improved damping, may result. For example, two to ten fluid channels, in particular, two to six fluid channels, may be produced. In this connection, such fluid channels may jointly incorporate the spring receptacle at least partially. In this manner, the flow characteristics may also improve. In principle, however, an embodiment having only one single fluid channel or a combination of at least one proposed fluid channel with at least one conventional through-hole is also conceivable.

Therefore, in particular, a refinement is implementable, in which there is, with regard to a stop face on the corresponding stop element, no more overlap between the respective opening or the respective openings of the at least one fluid channel and the stop face on the stop element. Due to this, the maximum damping surface is available.

BRIEF DESCRIPTION OF THE DRAWINGS

Preferred exemplary embodiments of the present invention are explained in greater detail in the following description, with reference to the figures, in which elements corresponding to each other are provided with matching reference numerals.

DETAILED DESCRIPTION OF EXAMPLE EMBODIMENTS

Figure 1:
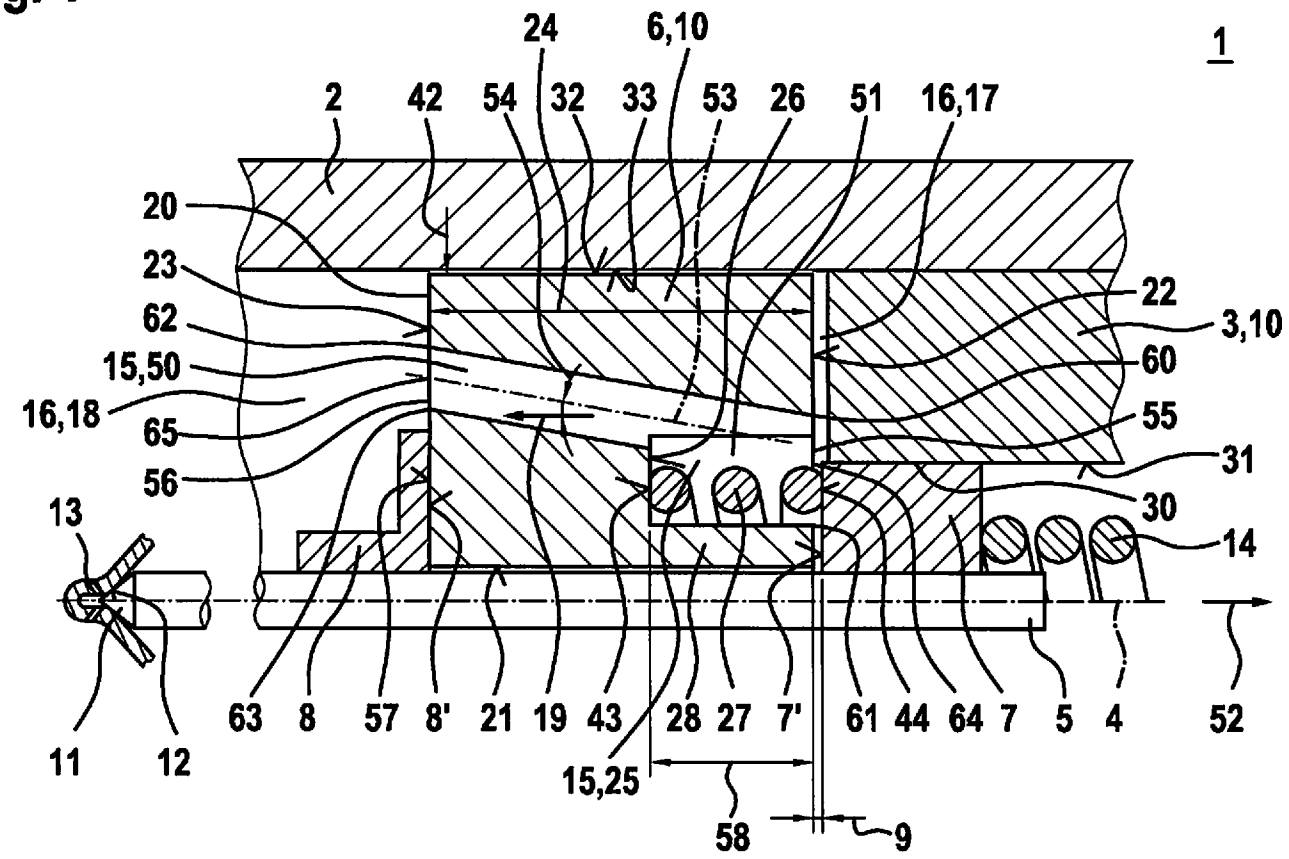
FIG. 1 shows a schematic sectional view of a portion of a valve according to a first exemplary embodiment.

FIG. 1 shows a schematic sectional view of a portion of a valve 1 for metering a fluid, according to a first exemplary embodiment. Valve 1 may take the form of, in particular, a fuel injector 1. One preferred application is a fuel injection system, in which such fuel injectors 1 take the form of high-pressure injectors 1 and are used for direct injections of fuel into assigned combustion chambers. In this connection, liquid or gaseous fuels may be used as fuel. Accordingly, valve 1 is suitable for metering liquid or gaseous fluids.

Valve 1 includes a housing (valve housing) 2, in which an internal pole 3 is stationary-mounted. In this exemplary embodiment, a valve needle 5 situated inside of housing 2 is guided along a longitudinal axis 4, relative to housing 2.

An armature (magnet armature) 6 is positioned on valve needle 5. In addition, a stop element 7 and a further stop element 8 are positioned on valve needle 5. Stop faces 7', 8' are formed on stop elements 7, 8. In this connection, upon actuation, armature 6 may be moved along longitudinal axis 4, relative to valve needle 5, between stop elements 7, 8, in which case a free travel 9 of the armature is predetermined. In this case, longitudinal axis 4 may be referred to as longitudinal axis 4 of valve needle 5 and/or as longitudinal axis 4 of armature 5. Armature 6, internal pole 3, as well as a magnetic coil not shown, are parts of an electromagnetic actuator 10.

A valve-closure member 11, which interacts with a valve-seat surface 12 to form a sealing seat, is formed on valve needle 5. Upon actuation of armature 6, it is accelerated in the direction of internal pole 3. When armature 6 strikes against limit stop 7' of stop element 7 and thereby actuates valve needle 5, fuel may then be injected through the open sealing seat and at least one nozzle opening 13 into a space, in particular, a combustion chamber.

Valve 1 includes a restoring spring 14, which moves valve needle 5 via stop element 7 into its starting position, in which the sealing seat is closed.

Armature 6 is based on a basic cylindrical form 20 having a through-hole 21; armature 6 being guided at through-hole 21, on valve needle 5. In this connection, basic form 20 of armature 6 has a length 24 between a first end face 22 of armature 6 facing internal pole 3 and a second end face 23 of armature 6 facing away from internal pole 3. Armature 6 is positioned in an armature space 16. In this connection, first end face 22 borders on a first region 17 of armature space 16. In addition, second end face 23 borders on a second region 18 of armature space 16. During operation, the passage of fuel through the armature over at least a portion of its length 24 is rendered possible by at least one fluid channel 15.

Armature 6 includes a spring receptacle 25. In this connection, fluid channel 15 also includes spring receptacle 25. Thus, fluid channel 15 leads through at least a portion of spring receptacle 25. Spring receptacle 25 is open at end face 22 of armature 6. A spring support surface 26, at which a spring 27 partially situated in spring receptacle 25 is supported, is formed by base 26 of spring receptacle 25. Spring 27 is also supported at stop face 7' of limit stop 7. Upon actuation of armature 6, spring 27 is shortened with respect to its starting length; it being able to be inserted completely into spring receptacle 25.

In this exemplary embodiment, spring 27 is also formed to have ground spring ends 43, 44. This provides an even more effective seat. In addition, this results in reduced wear, as well as more uniform application of force, to armature 6 at spring support surface 26, on one side, and at limit stop 7' of stop element 7, on the other side.

In this exemplary embodiment, a guide segment 28 is formed on armature 6. Due to this, the guide length of armature 6 on valve needle 5 is equal to length 24 of armature 6 between its end faces 22, 23.

In this exemplary embodiment, the guidance of valve needle 5 relative to longitudinal axis 4 and/or relative to housing 2 is carried out via stop element 7. In this connection, stop element 7 is guided in a guide region 30 at an inner bore 31 of internal pole 3. In one modified refinement, valve needle 5 may also be guided additionally or alternatively via armature 6. In this connection, at least part of the outside 32 of armature 6 extends to inner side 33 of housing 2. In this refinement, an annular gap between stop element 7 and internal pole 3 may then be produced in place of guide region 30.

In this exemplary embodiment, fluid channel 15 includes an oblique bore hole 50. In this connection, fluid channel 15 preferably has exactly one oblique bore hole 50. Fluid channel 15 then leads through oblique bore hole 50 and at least a portion 51 of spring receptacle 25.

In this exemplary embodiment, a direction 19 coaxial with regard to longitudinal axis 4 results, which is oriented from first end face 22 to second end face 23, in an orientation contrary to an opening direction 52, in which valve needle 5 is actuated during the opening of valve 1.

Oblique bore hole 50 is formed in armature 6 in such a manner, that it runs radially outwards along coaxial direction 19, that is, away from longitudinal axis 4; an angle of inclination 54 between coaxial direction 19 and an axis 53 of oblique bore hole 50 resulting in the drawing plane. However, the embodiment of oblique bore hole 50 is not limited to the axis' 53 being situated in the same plane as longitudinal axis 4 of valve needle 5, as is the case in the depicted exemplary embodiment having the plane given by the drawing plane.

In addition, in this exemplary embodiment, oblique bore hole 50 runs from first end face 22 of armature 6 to second end face 23 of armature 6. In this connection, a first opening 55 of fluid channel 15, which borders on first region 17, is situated in end face 22, while a second opening 56, which borders on second region 18, in situated in second end face 23. The oblique bore hole 50 running from first end face 22 to second end face 23 of armature 6 allows for an advantageous hydraulic connection between first region 17 and second region 18. The positioning of first opening 55 close to longitudinal axis 4 allows the fluid, in particular, the fuel, to flow from inner bore 31 of internal pole 3 into fluid channel 15 in an advantageous manner. The positioning of second opening 56 of fluid channel 15 away from longitudinal axis 4 allows an inner portion 57 of second end face 23, at which armature 6 interacts with second stop face 8, to be preselected to be sufficiently large in correspondence with a specified and, if desired, large, second stop face 8', without second opening's 56 being situated in this inner portion 57 and/or without fluid channel's 15 intersecting this inner portion 57 of second end face 23. This allows a large damping surface to be produced between second stop face 8' and second end face 23.

Since oblique bore hole 50 is intersected by spring receptacle 24 over an entire length 58 of spring receptacle 25 along longitudinal axis 4, favorable flow characteristics and a first opening 55 of fluid channel 15 even more enlarged with respect to spring receptacle 25 are produced. In this connection, in particular, a point 60, at which first opening 55 is at a maximum radial distance from longitudinal axis 4, is even outside of spring receptacle 25. On the other hand, a point 61, at which first opening 55 is at a minimum distance from longitudinal axis 4, is still at the edge of spring receptacle 25. In addition, points 62, 63 are apparent at second opening 56, in which case point 62 is situated at the edge of second opening 56, at a maximum distance away from longitudinal axis 4, and point 63 is situated at the edge of second opening 56, at a minimum distance from longitudinal axis 4. Viewed radially, point 62 is further away from longitudinal axis 4 than point 60. Viewed radially, point 63 of second opening 56 is also further away from longitudinal axis 4 than point 61 on the edge of first opening 55. In addition, a centroid 64 of first opening 55 is situated radially closer to longitudinal axis 4 than a centroid 65 of second opening 56.

In this exemplary embodiment, oblique bore hole 50 is formed in such a manner, that base 26 of spring receptacle 25 is intersected by oblique bore hole 50. Therefore, spring receptacle 25 may be used in an advantageous manner for allowing the fuel to pass through, and may be integrated in fluid channel 15 along its entire length 58.

Figure 2:
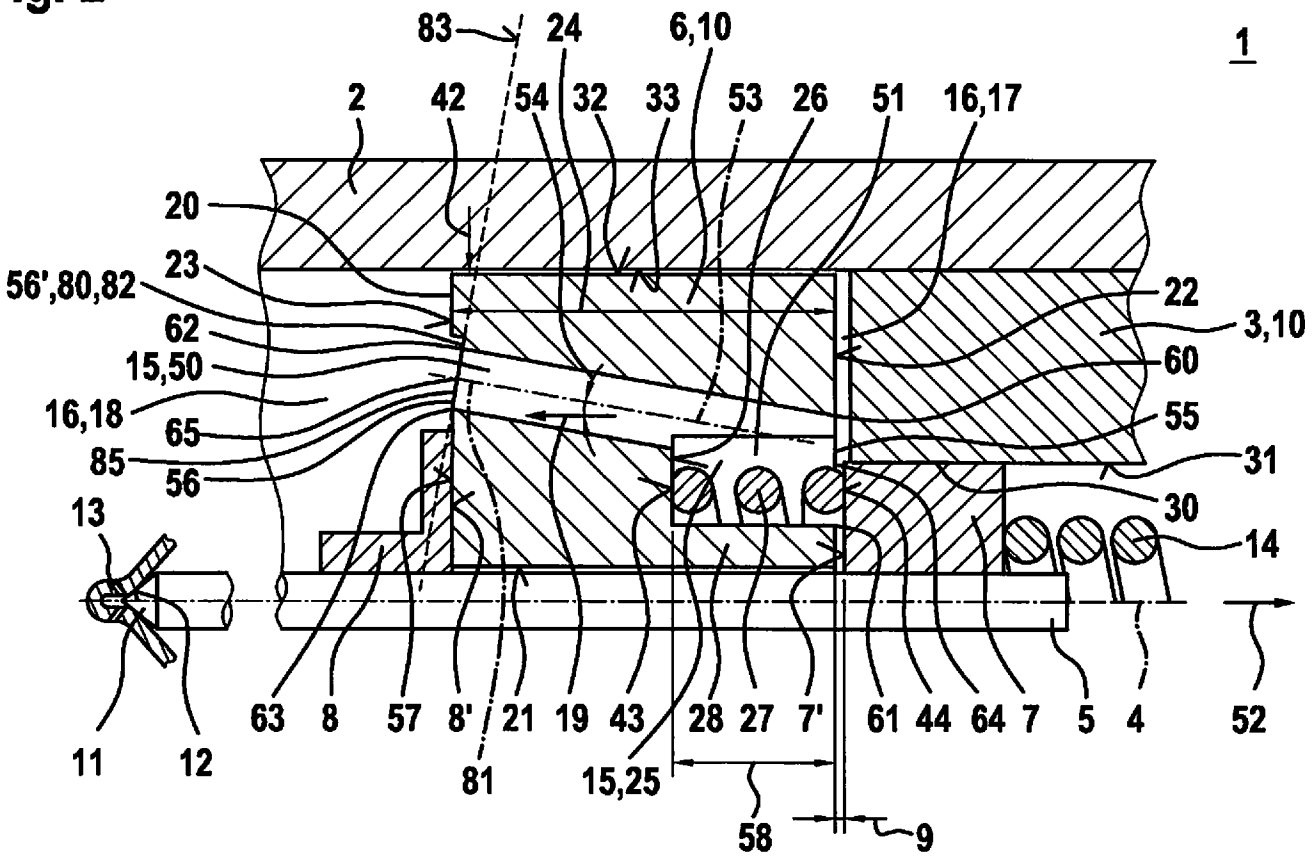
FIG. 2 shows a schematic sectional view of a portion of a valve according to a second exemplary embodiment.

FIG. 2 shows a schematic sectional view of part of a valve 1 according to a second exemplary embodiment. In this exemplary embodiment, at the second end face 23 of armature 6, in which second opening is situated, second opening 56 or a partial surface 56' is oriented perpendicularly to axis 53 of oblique bore hole 50. In this connection, partial surface 56' of armature 6 may be formed, using a circular groove 85 or individual countersinks. In particular, partial surface 56' may initially be formed at second end face 23 of armature 6, and oblique bore hole 50 may then be drilled, starting from second end face 23. This allows a drill bit to impinge upon partial surface 56' of armature 6 at right angles. Consequently, this produces, in particular, a modification to the first exemplary embodiment described with the aid of FIG. 1; the modification being optimized with regard to manufacturing and, in particular, being used for improving the drilling. Through this, fracture of a drill bit may also be prevented, since the drilling does not occur at an angle to a surface.

In this connection, with regard to a plurality of oblique bore holes to be produced on armature 6, which are formed in accordance with oblique bore hole 50, in particular, it is advantageous for partial surface 56' to take the form of a groove, which runs around longitudinal axis 4, and from which individual oblique bore holes 50 then start out in a circumferentially distributed manner.

Figure 3:
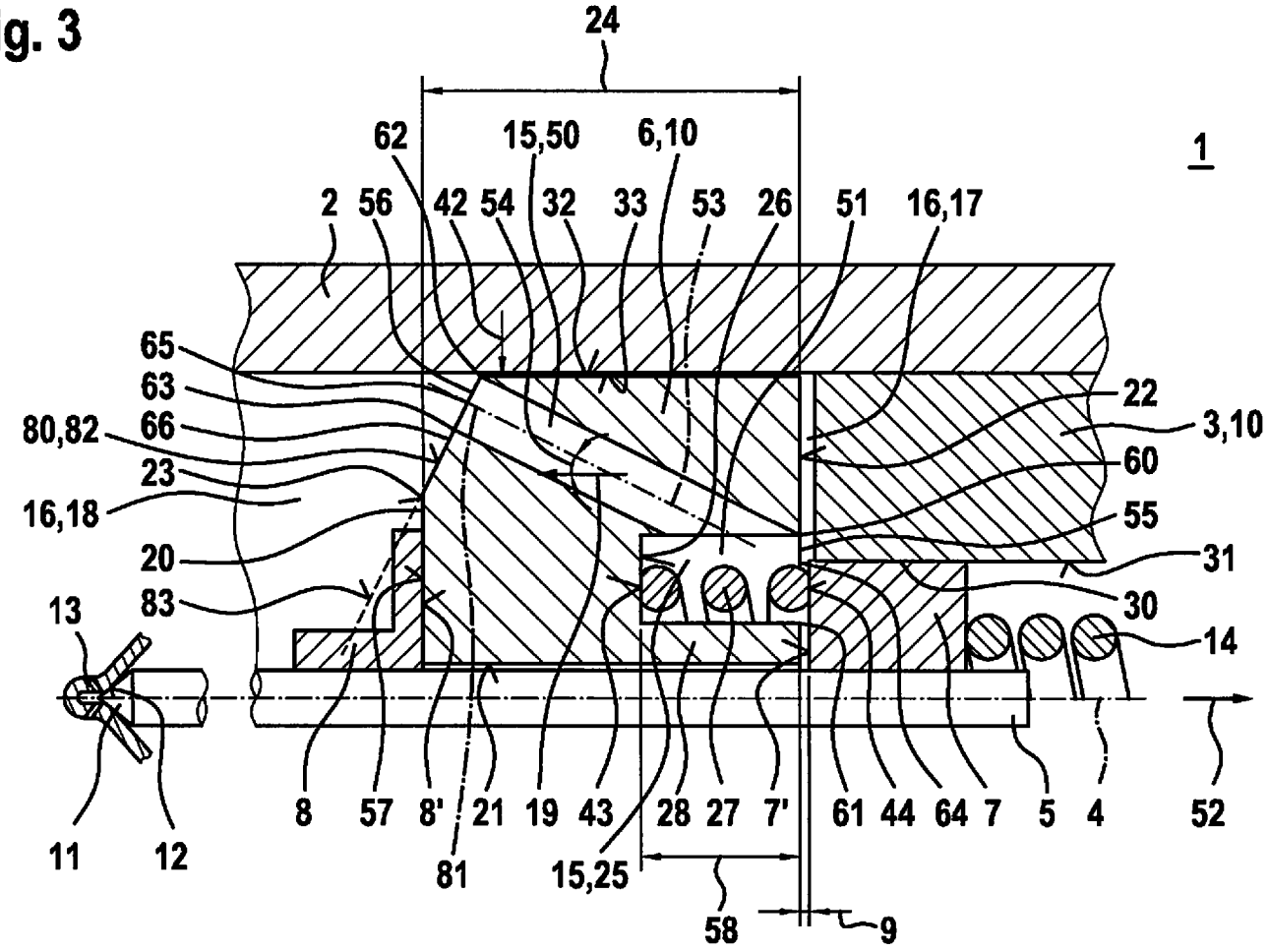
FIG. 3 shows a schematic sectional view of a portion of a valve according to a third exemplary embodiment.

FIG. 3 shows a schematic sectional view of part of a valve 1 according to a third exemplary embodiment. In this exemplary embodiment, a bevel 66, which cuts second end face 23 at its outer diameter 42, is formed on armature 6. Bevel 66 then lies between second end face 23 and outside 32 of armature 6. Bevel 66 is preferably formed at a right angle to axis 53 of oblique bore hole 50. First of all, this embodiment has the advantage that optimization of manufacturing is achieved, as is accordingly described in light of FIG. 2. In addition, inner portion 57 of second end face 23, at which armature 6 interacts with stop face 8', may be formed to have a maximum size. This produces a particularly high degree of structural latitude. Thus, in the specific application, a very high degree of hydraulic damping may be attained.

Figure 4:
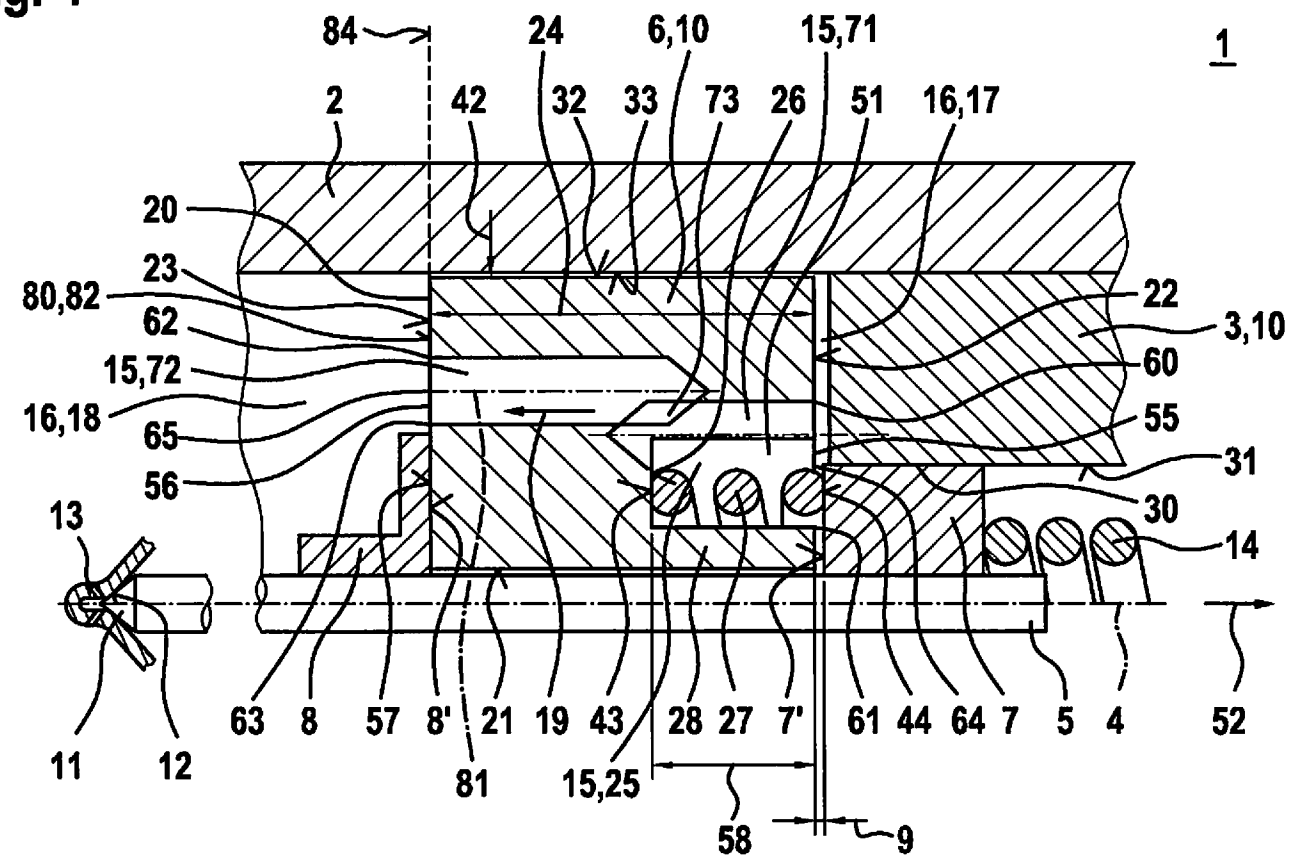
FIG. 4 shows a schematic sectional view of a portion of a valve according to a fourth exemplary embodiment.

FIG. 4 shows a schematic sectional view of a portion of a valve 1 according to a fourth exemplary embodiment. In this exemplary embodiment, fluid channel 15 has a first coaxial blind-end bore 71 and a second coaxial blind-end bore 72. Starting from first end face 22, first coaxial blind-end bore 71 runs in coaxial direction 19. Starting from second end face 23, second coaxial blind-end bore 72 runs contrary to coaxial direction 19. The two blind-end bores 71, 72 intersect each other inside of armature 6. In this case, viewed along longitudinal axis 4, a region of intersection 73 may be situated close to base 26 of spring receptacle 25. This produces favorable flow conditions. Blind-end bores 71, 72 and at least a portion 51 of spring receptacle 25 may then be used during the passage of the fluid through armature 6. In this exemplary embodiment, as well, this advantageously allows spring receptacle 25 to be integrated at least partially into fluid channel 15. Viewed in coaxial direction 19, in the region of intersection 73, the fluid is guided radially outwards along longitudinal axis 4. This also allows the fluid to be introduced advantageously into fluid channel 15, starting from inner bore 31 of internal pole 3 and, at the same time, provides advantageous damping at second stop element 8.

Thus, in particular, it is advantageous that a point 60 of a first opening 55 of fluid channel 15, lying radially far outwards from longitudinal axis 4 to a maximum extent, is closer to longitudinal axis 4 than a point 62 of a second opening 56 of fluid channel 15, lying radially far outwards from longitudinal axis 4 to a maximum extent. In addition, it is advantageous for a centroid 64 of a first opening 55 of fluid channel 15 to be situated closer to longitudinal axis 4 than a centroid 65 of a second opening 56 of fluid channel 15.

In the exemplary embodiments put forward, which are described, in particular, in light of FIGS. 2 through 4, it is advantageously feasible that at an outlet face 80 of armature 6, fluid channel 15 goes out to second region 18 of armature space 16; an axis 81 of fluid channel 15, along which fluid channel 15 emerges at outlet face 80 of armature 6, being oriented perpendicularly to outlet face 80. In this manner, it is possible, inter alia, to form fluid channel 15 from this side, using a bore hole, which may be introduced into the armature perpendicularly to outlet face 80, thereby improving producibility. In this connection, outlet face 80 may lie in an annular surface 82 running about longitudinal axis 4; the annular surface 82 taking the form of a partial surface 82 of a conical envelope 83 axially symmetric with regard to longitudinal axis 4, or the form of a partial surface 82 of a circular disk 84 oriented perpendicularly to longitudinal axis 4. This is possible, for example, by forming a circular groove 85 or a bevel 66.

The present invention is not limited to the exemplary embodiments described.

What is claimed is:

1. A valve for metering a fluid, comprising:

a valve housing, in which an internal pole is stationary-mounted;

an electromagnetic actuator which includes an armature situated in an armature space and positioned on a valve needle, wherein the valve needle is operable by the actuator using the armature, the armature being guided on the valve needle, wherein the valve needle is situated inside of the valve housing and is guided along a longitudinal axis of the valve needle and/or the armature, relative to the valve housing;

a first stop element that interacts with a first end face of a first stop element of the armature during operation, and a second stop element that interacts with a second end face of a second stop element of the armature during operation, situated on the valve needle, the first stop element and the second stop element limiting a movement of the armature relative to the valve needle, the armature having a spring receptacle which is open towards the first end face of the armature, and into which a spring supported at the first stop element is inserted, wherein the first stop element and the second stop element are positioned on the valve needle;

a valve-closure member, which interacts with a valve-seat surface to form a sealing seat, is formed on the valve needle, wherein upon actuation of the armature, the valve-closure member is accelerated in a direction of the internal pole, and wherein when the armature strikes against the first stop element, which is a limit stop, to actuate the valve needle, the fluid is then injected through the sealing seat in an open configuration, and at least one nozzle opening, into a space;

wherein the armature has at least one fluid channel, which, during operation, allows the fluid to pass through between a first region of the armature space bordering on the first end face of the armature and a second region of the armature space bordering on the second end face of the armature, the at least one fluid channel incorporating at least a portion of the spring receptacle, and wherein the at least one fluid channel runs radially outwardly in sections, along a direction, which is oriented from the first end face towards the second end face and is coaxial relative to the longitudinal axis, wherein the at least one fluid channel includes an oblique bore hole, wherein the at least one fluid channel leads through the oblique bore hole and at least a portion of the spring receptacle, wherein a coaxial direction with regard to the longitudinal axis results, which is oriented from the first end face to the second end face, wherein the oblique bore hole is formed in the armature so that it runs radially outwards along the coaxial direction and away from the longitudinal axis, so that there is an angle of inclination between the coaxial direction and an axis of oblique bore hole, and wherein the at least one fluid channel includes a first coaxial blind-end bore, which runs in the coaxial direction, starting from the first end face of the armature, and a second coaxial blind-end bore, which runs contrary to the coaxial direction, starting from the second end face of the armature.

2. The valve as recited in claim 1, wherein the valve includes a fuel injector for an internal combustion engine.

3. The valve as recited in claim 1, wherein a point of a first opening of the at least one fluid channel, away from the longitudinal axis, lying radially inwards to a maximum extent, is located closer to the longitudinal axis than a point of a second opening of the at least one fluid channel, away from the longitudinal axis, lying radially inwards to a maximum extent.

4. The valve as recited in claim 1, wherein the at least one fluid channel goes out to the second region of the armature space at an outlet face of the armature, and an axis of the at least one fluid channel, along which the at least one fluid channel emerges at the outlet face of the armature, is oriented perpendicularly to the outlet face.

5. The valve as recited in claim 1, wherein an outlet face lies in an annular surface running about the longitudinal axis, and the annular surface is in the form of a partial surface of a conical envelope axially symmetric with regard to the longitudinal axis, or is in the form of a partial surface of a circular disk oriented perpendicularly to the longitudinal axis.

6. The valve as recited in claim 1, wherein the at least one fluid channel runs continuously radially outwards along the coaxial direction.

7. The valve as recited in claim 1, wherein the at least one fluid channel includes the at least one oblique bore hole, which runs at least radially outwards along the coaxial direction.

8. The valve as recited in claim 7, wherein the oblique bore hole runs from the first end face of the armature to the second end face of the armature.

9. The valve as recited in claim 7, wherein the oblique bore hole is intersected by the spring receptacle.

10. The valve as recited in claim 7, wherein the oblique bore hole is intersected by the spring receptacle so that a base of the spring receptacle is cut by the oblique bore hole.

11. The valve as recited in claim 1, wherein the first coaxial blind-end bore and the second coaxial blind-end bore intersect each other inside of the armature, and with regard to the longitudinal axis, the second blind-end bore is situated radially further outwards than the first blind-end bore.

12. The valve as recited in claim 1, wherein the armature has a cylindrical form having a through-hole, wherein the armature is guided at the through-hole, on the valve needle, wherein the cylinder form of the armature has a length between the first end face of the first stop element of the armature facing the internal pole and the second end face of the second stop element of the armature facing away from the internal pole, wherein the armature is positioned in the armature space, in which the first end face borders on a first region of the armature space and in which the second end face borders on a second region of the armature space, and wherein during operation, the fuel passes through the armature over at least a portion of its length by the at least one fluid channel.

13. The valve as recited in claim 12, wherein the armature includes the spring receptacle, wherein the at least one fluid channel also includes the spring receptacle, wherein the at least one fluid channel leads through at least a portion of the spring receptacle, wherein the spring receptacle is open, wherein a spring support surface, at which the spring partially situated in the spring receptacle is supported, is formed by a base of the spring receptacle, and wherein upon actuation of the armature, the spring is shortened with respect to its starting length; so that it is insertable completely into the spring receptacle.

14. The valve as recited in claim 1, wherein the armature includes the a spring receptacle, wherein the at least one fluid channel also includes the spring receptacle, wherein the at least one fluid channel leads through at least a portion of the spring receptacle, wherein the spring receptacle is open, wherein a spring support surface, at which the spring partially situated in the spring receptacle is supported, is formed by a base of the spring receptacle, and wherein upon actuation of the armature, the spring is shortened with respect to its starting length; so that it is insertable completely into the spring receptacle.

15. A valve for metering a fluid, which is a fuel injection valve for an internal combustion engine, comprising:

an electromagnetic actuator, which has an armature in an armature chamber, and which is positioned on an armature operable valve needle, so that the armature is guided on the valve needle, wherein the valve needle is situated inside of a valve housing and is guided along a longitudinal axis of the valve needle and/or the armature, relative to the valve housing;

a first stop element which, during operation, interacts with a first end face of the armature on the valve needle;

a second stop element which, during operation, interacts with a second end face of the armature, and limits a movement of the armature relative to the valve needle; and a valve-closure member, which interacts with a valve-seat surface to form a sealing seat, is formed on the valve needle, wherein upon actuation of the armature, the valve-closure member is accelerated in a direction of the internal pole, and wherein when the armature strikes against the first stop element, which is a limit stop, to actuate the valve needle, the fluid is then injected through the sealing seat in an open configuration, and at least one nozzle opening, into a space;

wherein the armature has a spring receptacle which is open towards the first end face of the armature and into which a spring supported on the stop element is inserted, wherein the armature has at least one fluid channel which, during operation, allows fluid to be passed through between a first region of the armature space adjoining the first end face of the armature and a first region adjoining the second area of the armature space adjoining the second end face of the armature allows the fluid channel to at least partially include the spring receptacle and the fluid channel to run along one of the first end face in a direction oriented towards the second end face and coaxial with respect to a longitudinal axis, at least in sections extending radially outwards, wherein the fluid channel has at least one oblique or inclined bore which runs at least radially outwards along the coaxial direction, wherein the oblique or inclined bore intersects or is miscut with a spring mount over an entire length of the spring mount along a longitudinal axis, wherein a radially external point at a maximum distance from the longitudinal axis is outside the spring receptacle or is radially directly on the edge of the spring receptacle.

16. The valve as recited in claim 15, wherein a point of a first opening of the fluid channel that is radially at a maximum inner location from the longitudinal axis is closer to the longitudinal axis than a point a second opening of the fluid channel.

17. The calve as recited in claim 15, wherein the fluid channel exits at an exit surface of the armature towards the second region of the armature space, and wherein an axis of the fluid channel, along which the fluid channel exits at the exit surface of the armature, is oriented perpendicular to the exit surface.

18. The valve as recited in claim 15, wherein the exit surface lies in an annular surface that runs around the longitudinal axis and that the annular surface as a partial surface of a cone shell, which is rotationally symmetrical with respect to the longitudinal axis, or as a partial surface a circular disc oriented perpendicularly to the longitudinal axis.

19. The valve as recited in claim 15, wherein the fluid channel along the coaxial direction runs continuously radially outwards.

20. The valve as recited in claim 15, wherein the oblique or inclined bore runs from the first end face of the armature to the second end face of the armature.

21. The valve as recited in claim 15, wherein the oblique or inclined bore is intersected with the spring mount so that a bottom of the spring mount is cut into by the oblique or inclined bore.

22. The valve as recited in claim 15, wherein the spring receptacle includes an annular groove not adjoining the valve needle, so that a guide web is formed on the armature.

* * * * *